US009810041B2

(12) United States Patent
Parker et al.

(10) Patent No.: US 9,810,041 B2
(45) Date of Patent: Nov. 7, 2017

(54) METHOD AND DEVICE FOR CLEANING CONTROL PARTICLES IN A WELLBORE

(71) Applicant: Blue Spark Energy Inc., Calgary (CA)

(72) Inventors: Todd Parker, Calgary (CA); Shawn Carroll, Calgary (CA); Dan Skibinski, Calgary (CA)

(73) Assignee: Blue Spark Energy Inc., Calgary (CA)

( * ) Notice: Subject to any disclaimer, the term of this patent is extended or adjusted under 35 U.S.C. 154(b) by 0 days.

(21) Appl. No.: 14/807,597

(22) Filed: Jul. 23, 2015

(65) Prior Publication Data

US 2016/0024888 A1 Jan. 28, 2016

Related U.S. Application Data

(60) Provisional application No. 62/028,504, filed on Jul. 24, 2014.

(51) Int. Cl.
*E21B 37/08* (2006.01)
*E21B 28/00* (2006.01)
*E21B 37/00* (2006.01)

(52) U.S. Cl.
CPC ..... *E21B 37/08* (2013.01); *E21B 28/00* (2013.01); *E21B 37/00* (2013.01)

(58) Field of Classification Search
CPC ..... E21B 37/08; E21B 28/00; E21B 37/00
See application file for complete search history.

(56) References Cited

U.S. PATENT DOCUMENTS 5,004,050 A * 4/1991 Sizonenko ..... E21B 43/003 166/248
2007/0187090 A1* 8/2007 Nguyen ..... E21B 37/06 166/249
2010/0071898 A1* 3/2010 Corre ..... E21B 33/12 166/264
2011/0139441 A1* 6/2011 Zolezzi Garreton ... E21B 28/00 166/249
2014/0027110 A1* 1/2014 Ageev ..... H05H 1/52 166/249

* cited by examiner

*Primary Examiner* — Brad Harcourt
(74) *Attorney, Agent, or Firm* — Klein, O'Neill & Singh, LLP

(57) ABSTRACT

The invention concerns a method for cleaning control particles in a wellbore of a subterranean formation to improve the recovery of formation fluids and/or gases, said wellbore comprising a wall defining a borehole, at least one control equipment arranged into said borehole and a plurality of control particles arranged between said control equipment and said wall, said method comprising the steps of generating at least one shock wave nearby said control equipment and propagating said at least one shock wave through said control equipment toward said control particles for cleaning said control particles.

15 Claims, 5 Drawing Sheets

METHOD AND DEVICE FOR CLEANING CONTROL PARTICLES IN A WELLBORE

FIELD OF THE ART

The field of art relates to the cleaning of a wellbore and associated equipment and, more particularly, to a method and device for cleaning control particles arranged in a wellbore in order to improve the recovery of formation fluids and/or gases.

The prevent invention includes devices, systems, and methods. A preferred application of the invention concerns removing mineral deposits and reservoir fines from control particles arranged in a wellbore of a subterranean formation and/or redistributing mineral deposits and reservoir fines between control particles arranged in a wellbore of a subterranean formation.

BACKGROUND OF THE ART

In the art of well boring, a borehole is drilled into the earth through the oil or gas producing subterranean formation or, for some purposes, through a water bearing formation or a formation into which water or gas or other liquids that are to be injected.

Completion of a well may be carried out in a number of ways dependent upon the nature of the formation of interest. Where the formation itself or formations above the formation of interest have a tendency to disintegrate and/or cave into the hole, like e.g. sand formations, it is known to use a filter apparatus to control unconsolidated formation elements while allowing the passage of oil or gas from the formation in conjunction with particles or solids.

For example, in sand formations, one common type of filter apparatus, called gravel pack, involves placing a control screen in the wellbore and packing the annulus between the screen and the wellbore wall with control particles of a specific size designed to prevent the passage of formation sand. Such control particles are made of a granular material such as for example gravels, ceramics or sintered bauxite. The main objective is to stabilize the formation while causing minimal impairment to well productivity, which means that it is critical to completely pack the space between the screen and the formation, preventing the movement of formation particles.

In addition to the use of control screens or similar apparatus, gravel packing operations may involve the use of a wide variety of control equipment, including liners (e.g., slotted liners, perforated liners, etc.), combinations of liners and screens, and other suitable apparatus. A wide range of sizes and screen configurations are available to suit the characteristics of the control particles used. Similarly, a wide range of sizes of control particles are available to suit the characteristics of the unconsolidated formation elements. The resulting structure presents a barrier to migrating sand from the formation while still permitting fluid or gas flow.

Another type of filter apparatus involves placing a control screen in the wellbore and packing the annulus between said control screen and the wellbore wall with control particles of a specific size designed to keep formation fissures open. In this case, the control particles, called proppant agents, may be for example sand or stone, ceramics or sintered bauxite.

In any event, after a period of production, injection or transportation of fluids or gases, there is a tendency for the interstitial space between control particles to become plugged with various types of residues. For example, organic residues like paraffin, asphalts and other agglomerating residues of petroleum origin often cause plugging problems. Usually these deposits may cause significant problems, because of their composition and the fact that they may precipitate under certain conditions (pressure, temperature, liquid composition, injection . . . ).

These materials of mineral or organic origins either together with chemicals from water, normally produced with the oil, such as, calcium carbonate, calcium sulfate, barium sulfate, sulfur and the like, or such chemicals themselves have a tendency to form extremely hard deposits on different parts of the components. Such deposits may adhere to the control particles, blocking the interstitial spaces between said control particles, therefore reducing or completely preventing the flow of fluids or gases through the control particles to the borehole. Similar problems may also be encountered due to precipitates build on the control screen, due to pressure drop and temperature considerations and the gravel pack like e.g. solid salts (for example calcium or barium sulfates, calcium carbonate, calcium/barium scales, etc. . . . ).

Another challenge encountered while using a control apparatus is migrating fines that plug the control particles and the control screen, impeding fluid flow and causing production levels to drop. As used in this disclosure, the term "fines" refers to loose elements, such as formation fines, formation sand, clay particles, coal fines, resin particles, crushed control particles, and the like. These migrating fines may also obstruct fluid pathways through the control apparatus lining the well. In particular, in situ fines mobilized during production, or injection, may lodge themselves in control screens, preventing or reducing fluid flow there through. Migrating fines may also be associated with either organic and or mineral precipitation byproducts downhole.

Well-stimulation techniques using chemical agents, such as matrix acidizing, have been developed to remediate wells affected by these problems. An existing solution using chemical agents for cleaning gravel packs is described e.g. in patent U.S. Pat. No. 7,896,080B1. In matrix acidizing, thousands of gallons of acid are injected into the well to dissolve away precipitates, fines, or scale deposits on the inside of tubular parts, trapped in the openings of the control screen, or in the pore spaces of gravel pack or matrix formation. However, acidizing may not in all cases allow in most cases dissolving significant amounts of the plugging materials as acid does not penetrate more than a few inches behind the control screen. Moreover, chemicals may damage the control particles, which can break into pieces or in the case of clays swell them, therefore reducing or completely preventing the flow of fluids or gases through the control particles and the control screen. Furthermore, existing chemicals treatments may not be efficient in horizontal boreholes due to the volumes required or the paths the chemicals take. Additionally, the acid must is usually removed from the well. Often, depending on well fluids and reservoir composition, the well must also be flushed with pre- and post-acid solutions. Aside from the difficulties of determining the proper chemical composition for these fluids and pumping them down the well, the environmental costs of matrix acidizing can render the process undesirable. Additionally, matrix acidizing treatments generally only provide a temporary solution to these problems and do not take into consideration root cause.

Alternative mechanical techniques may also be used to clean gravel packs. For example, a cleanup liquid may be introduced into control particles utilizing pressure pulses or jets as described in patent application US2005061503A1 or in patent application US2007187090A1. Typically, these techniques do not facilitate removal of significant amounts of the plugging materials as the cleanup liquid does not penetrate more than a few inches behind or into the control screen. There are also instances where, the cleanup liquid may damage the control particles, which can break into pieces, therefore reducing or completely preventing the flow of fluids or gases through the control particles to the screen. Furthermore, such techniques are not efficient in horizontal borehole as the cleanup liquid falls down with gravity.

It is therefore an object of the present disclosure is to provide an improved method and device for efficiently, rapidly, easily and effectively cleaning control particles arranged in a borehole extending into the earth without damaging said control particles or degrading the nearby environment. Another and further object of the present invention is to provide an improved method and device for removing deposits encrusted on control particles, in particular in areas where the control particles are accessible with difficulty or inaccessible. Yet another object of the present invention is to provide an improved method and device for increasing the production of fluids or gases from a subsurface earth formation or increasing the injectivity of fluids or gases into such formations.

SUMMARY

To this end, the present invention concerns a method for cleaning control particles in a wellbore of a subterranean formation to improve the recovery of formation fluids and/or gases, said wellbore comprising a wall defining a borehole, at least one control equipment arranged into said borehole and a plurality of control particles arranged between said control equipment and said wall, said method comprising the steps of generating at least one shock wave nearby said control equipment and propagating said at least one shock wave through said control equipment toward said control particles for cleaning said control particles.

The control particles of a specific size are designed to prevent the passage of elements such as sand and/or fines and constitute a barrier to migrating elements while still permitting fluid flow from the formation. In other words, the control equipment acts as a filter which allows the passage of formation fluids and/or gases while retaining the control particles against the wall of the borehole and preventing elements such as e.g. sand from passing through.

The method according to the invention allows thus efficiently, easily and rapidly cleaning the control particles arranged between the control equipment and the wellbore wall while not damaging the formation (unlike e.g. acid). Advantageously, the propagated at least one shock wave may reach control particles which are accessible with difficulty or inaccessible to chemical and/or mechanical means. In particular, the propagated at least one shock wave may reach control particles which are arranged in perforations extending into the formation for collecting formation fluids. Moreover, the method according to the invention is particularly efficient for removing deposits, in particular mineral deposits, from said control particles. The method according to the invention. In fact the shock wave invention would complement the use chemical or mechanical means by creating pathways through said control particles and control equipment.

In one embodiment of the method according to the invention, the control particles are ceramic control particles. The control particles may also be other types of granular material such as gravel, sand, sintered bauxite, proppant particles, metals, any other suitable control particles allowing preventing the passage of formation sand while still permitting fluid flow from the formation. The method according to the invention is particularly efficient for removing mineral deposits from ceramic control particles.

Moreover, the method according to the invention allows advantageously cleaning control particles and the control equipment simultaneously. The control equipment may be a screen, a liner (e.g. a slotted liner, a perforated liner, a mesh screen etc.), a combination of a liner and a screen or any other suitable apparatus. In a preferred embodiment, the control equipment is a control screen.

Advantageously, the control screen is a pipe, the control particles being packed or wound into the annulus defined between said pipe and the wellbore wall.

In particular, the at least one propagated shock wave may reach areas where the control particles are located and which accessible with difficulty or inaccessible to mechanical means such as e.g. brushes, scrapers or pigs or to chemical means such as e.g. acid.

In an embodiment according to the invention, a series of at least ten shock waves is generated for efficiently removing deposits from the control particles.

In a preferred embodiment, a plurality of series of shock waves is generated, each series of shock waves being generated repeatedly at different locations near the control equipment, for example different heights of a control screen. Preferably, the different locations are regularly spaced.

Using a plurality of series of shock waves allows advantageously removing most of the deposits from control particles, between 80-95% and preferably more than 95% of the deposits.

Preferably, the at least one shock wave propagates radially.

In another embodiment, the at least one shock wave propagates in a predetermined direction.

In a preferred embodiment, the at least one shock wave is generated in a transmitting liquid which is at least partially delimited by a membrane and the at least one shock wave is propagated through said membrane toward the control particles for cleaning said control particles. Such a membrane improves the effectiveness of the propagation from the liquid to the control particles.

The invention also concerns a shock wave generation device for cleaning control particles in a wellbore of a subterranean formation to improve the recovery of formation fluids and/or gases, said wellbore comprising a wall defining a borehole, at least one control equipment arranged into said borehole and a plurality of control particles arranged between said control equipment and said wall, said device comprising:

- a chamber which is partially filled with a shock wave transmitting liquid and which is adapted to be arranged into said borehole nearby said control equipment; and
- an electrical discharge unit for generating at least one electrical discharge that propagates at least one shock wave into said shock wave transmitting liquid through said control equipment and said control particles for cleaning said control particles.

In a preferred embodiment, the chamber is at least partially delimited by a membrane and the electrical discharge unit is configured for generating at least one electrical discharge that propagates at least one shock wave into said shock wave transmitting liquid through said membrane nearby said control equipment for cleaning said control particles.

The membrane improves the effectiveness of the propagation from the liquid to the control equipment and the control particles. Moreover, such a membrane isolates the liquid in the chamber from elements of the wellbore surrounding the shock wave generating device, such as e.g. mud or other fluids, while maintaining acoustic coupling with the control equipment. Such a flexible membrane prevents in particular the deposits and other elements from damaging electrodes and other components (insulators) of the electrical discharge unit.

Preferably, the membrane is deformable and/or flexible and/or elastic in order to conduct efficiently the shock wave toward the control particles.

In an embodiment according to the invention, the membrane is made of fluorinated rubber or other fluoroelastomer.

In an embodiment according to the invention, the relative elongation of the membrane is at least 150%, preferably at least 200% in order to be used efficiently in oils, fuels, liquid reservoirs, aliphatic or aromatic hydrocarbons etc. . . .

In an embodiment according to the invention, the membrane is operable between −35° C. and 250° C. in order to be used in oils, fuels, liquid reservoirs, aliphatic and/or aromatic hydrocarbons etc. . . .

In a preferred embodiment according to the invention, the electrical discharge unit comprises a power conversion unit, a power storage unit, a discharge control unit and a discharge system.

Preferably, the discharge system comprises a first electrode and a second electrode for generating a high voltage arc in the shock wave transmitting liquid.

Preferably, the electrical discharge unit is configured for generating at least one electrical discharge that propagates at least one shock wave radially.

In another embodiment, the electrical discharge unit is configured for generating at least one electrical discharge that propagates at least one shock wave in a predetermined direction.

The invention also concerns the use of a shock wave generation device as previously described for cleaning control particles in a wellbore of a subterranean formation to improve the recovery of formation fluids and/or gases, said wellbore comprising a wall defining a borehole, at least one control equipment arranged into said borehole and a plurality of control particles arranged between said control equipment and said wall.

The invention also concerns a system for cleaning control particles in a wellbore of a subterranean formation to improve the recovery of formation fluids and/or gases, said wellbore comprising a wall defining a borehole, at least one control equipment arranged into said borehole and a plurality of control particles arranged between said control equipment and said wall, said system comprising:

- a shock wave generation device as previously described;
- a wireline coupled to said shock wave generation device for inserting said shock wave generation device in the borehole nearby said control equipment;
- a voltage source located external of the borehole; and
- an electrical circuit within said wireline for connecting said voltage source to the shock wave generation device.

The invention also concerns a wellbore for recovering formation fluids or gases from a subterranean formation, said wellbore comprising a wall defining a borehole, at least one control equipment arranged into said borehole, a plurality of control particles arranged between said control equipment and said wall, and a device as previously described.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

Figure 1:
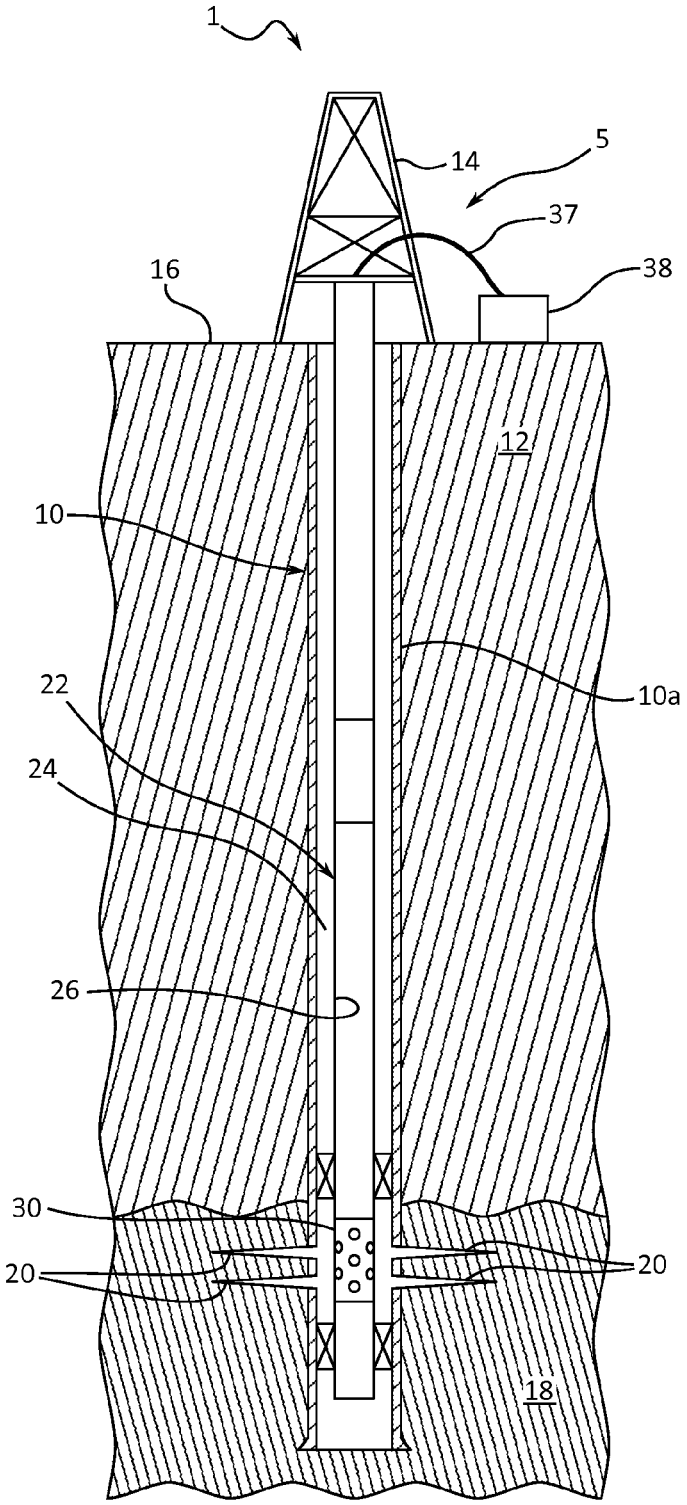
FIG. 1 illustrates a cross-sectional view of a wellbore comprising a completion string.

In the accompanying Figures, similar components or features, or both, may have the same or a similar reference label.

DETAILED DESCRIPTION

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification.

Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use.

Spatial terms describe the relative position of an object or a group of objects relative to another object or group of objects. The spatial relationships apply along vertical and horizontal axes. Orientation and relational words including "uphole" and "downhole"; "above" and "below"; "up" and "down" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided.

Where the Specification and appended Claims reference a method comprising two or more defined steps, the defined steps can be carried out in any order or simultaneously except where the context excludes that possibility.

The invention is described hereunder in reference to a well for producing formation fluids or gases such as e.g. oil wherein the formation is a sand formation. This does not limit the scope of the present invention which may be used with any type of formation wherein formation elements arranged on or between control particles of a formation control apparatus could prevent the passage of formation fluids or gases.

As shown in FIG. 1, an exemplary wellbore 1 comprising a system 5 according to the invention arranged in the wellbore 1.

The wellbore 1 comprises a borehole 10 which is drilled through the earth 12 from a drilling rig 14 located at the surface 16. The borehole 10 defines a wall 10*a* and is drilled down to a sand hydrocarbon-bearing subterranean formation 18. Perforations 20 extend outwardly into the formation 18, creating therefore fractures within said formation near the borehole 10.

A production tubing string 22 extends within the borehole 10 from the surface 16. An annulus 24 is defined between the production tubing string 22 and a wall of the surrounding borehole 10. A production flowbore 26 passes inside the production tubing string 22 for the transport of production fluids from the formation 18 to the surface 16.

Figure 2:
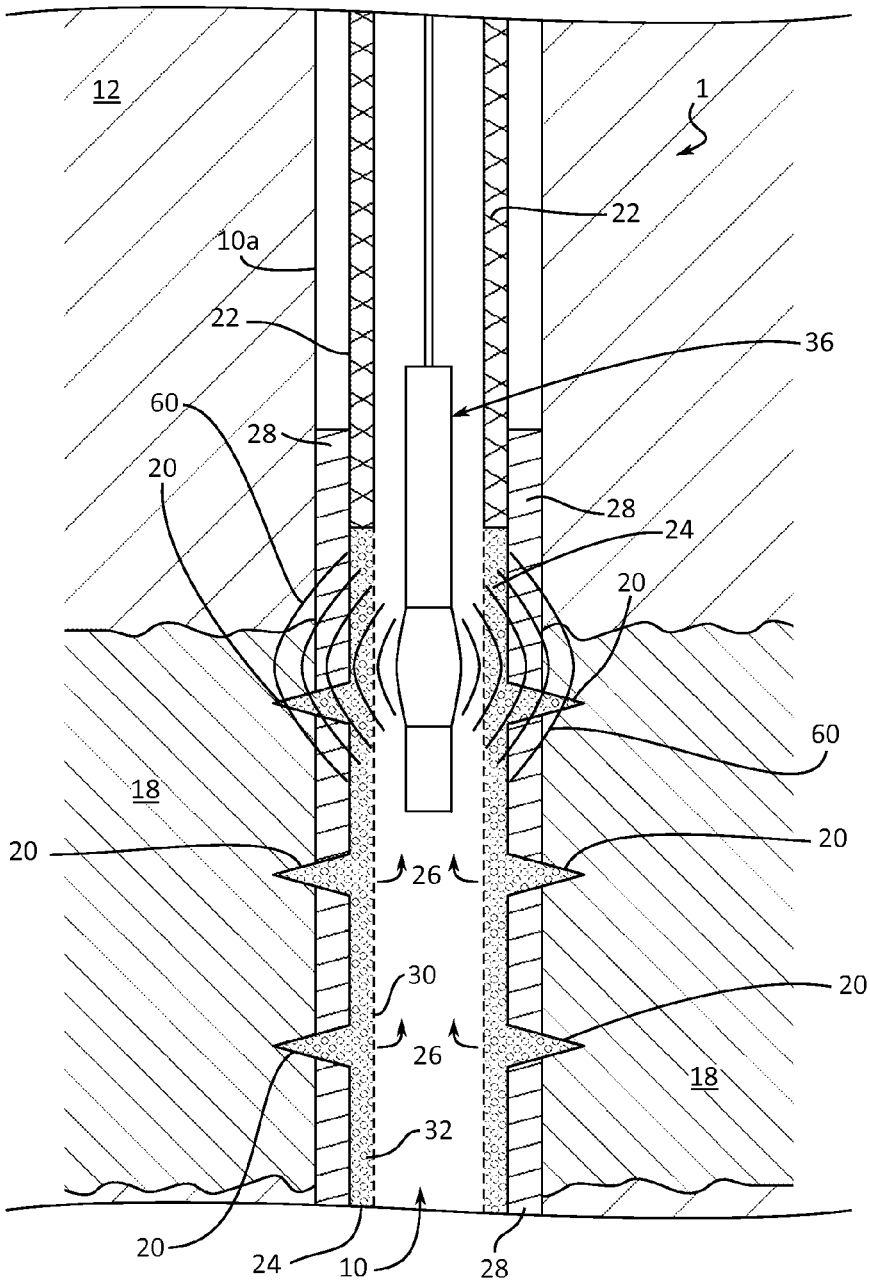
FIG. 2 illustrates a cross-sectional view of an embodiment of the shock wave generation device according to the invention located into a control screen nearby a sand formation.

FIG. 2 shows a detailed view of the wellbore 1 and the production tubing string 22 in the formation 18. A cemented wall 28 is built against the borehole wall 10*a* and perforations 20 extend outwardly through said cemented wall into the formation 18.

In order to prevent the passage of sand trough the perforations 20 from the formation 18 into the production tubing string 22 when recovering hydrocarbons, a sand control apparatus is arranged in a portion of the borehole 10 located in the formation 18.

The sand control apparatus comprises a control screen 30 and a plurality of control particles 32 arranged between the cemented wall 28 and said control screen 30. In another embodiment, the wellbore 1 may be deprived of cemented wall and be thus an open wellbore 1.

The annulus 24 between the cemented wall 28 and the control screen 30 is packed with control particles 32 of a specific size designed to prevent the passage of formation sand and/or fines from the formation 18 to the production flowbore 26.

These control particles 32 constitute a barrier or filter to migrating sand or formation particles while still permitting fluid flow from the formation 18. The control screen 30 and the control particles 32 allow stabilizing the formation 18 while causing minimal impairment to well productivity.

In another embodiment, control particles 32 could be used for example as proppant control particles. A proppant is a solid material, typically treated sand or man-made ceramic materials, designed to keep an induced hydraulic fracture open, during or following a fracturing treatment.

In addition to the use of sand control screens, other types of sand control equipment known from the person skilled in the art may be used in the borehole 10, including liners (e.g., slotted liners, perforated liners, etc.), combinations of liners and screens, and other suitable apparatus. A cylindrical metallic casing could also be installed in the borehole 10 between the control screen 30 and the wall 10*a* of the borehole 10.

A wide range of sizes and screen configurations are available to suit the characteristics of the control particles 32 used. Similarly, a wide range of sizes of control particles 32 are available to suit the characteristics of the formation sand or reservoir particles.

Control particles 32 may be for example gravels, sintered bauxite or ceramics such as e.g. CARBOLITE®. Ceramic control particles have a bulk density and specific gravity similar to sand, yet providing high flow capacity for enhanced production rates. Standard sizes for ceramic control particles are: 12/18, 16/20, 20/40 and 30/50 Mesh.

Figure 3:
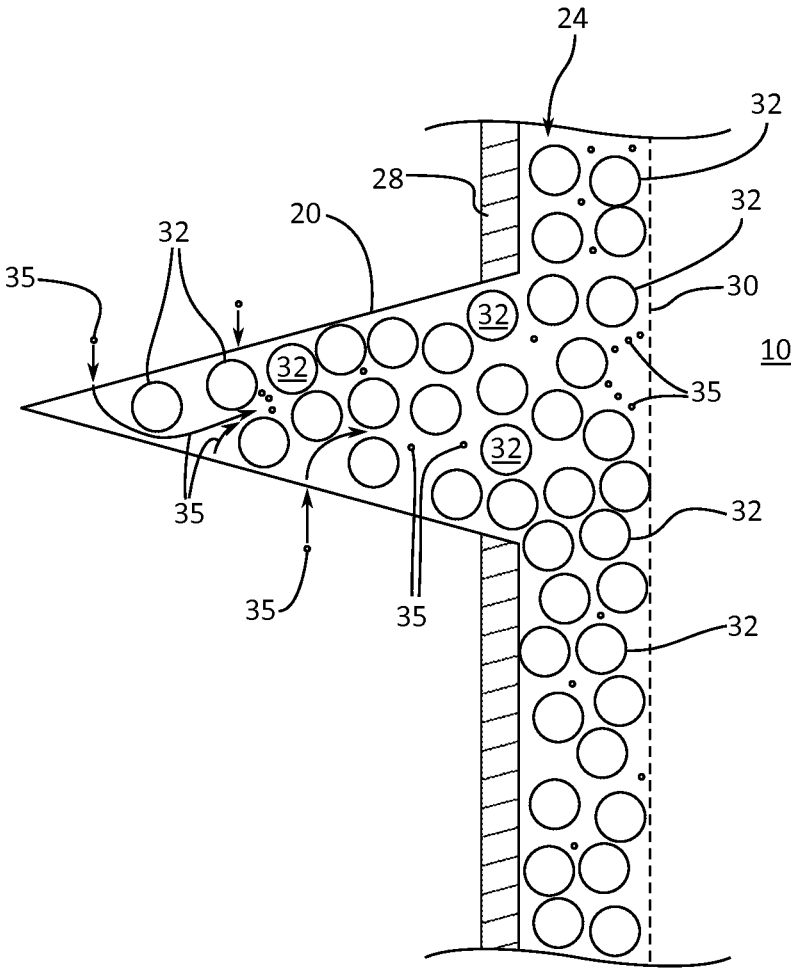
FIG. 3 schematically illustrates control particles arranged in a perforation extending into a sand formation.

Turning now to FIG. 3, an exemplary embodiment of an arrangement of control particles 32 is shown. A significant amount of blocking elements 35, such as e.g. mineral deposits, fines and/or formation sand grains, is located on or in between control particles 32 prior to applying the method according to the invention.

In reference to FIGS. 1 and 2, the system 5 comprises a shock wave generation device 36, a wireline 37 coupled to said shock wave generation device 36 for raising and lowering said shock wave generation device 36 in the production tubing string 22 nearby control screen 30 and control particles 32, a voltage source 38 located external of the borehole 10 and an electrical circuit within said wireline 37 for connecting said voltage source 38 to the shock wave generation device 36.

Figure 4:
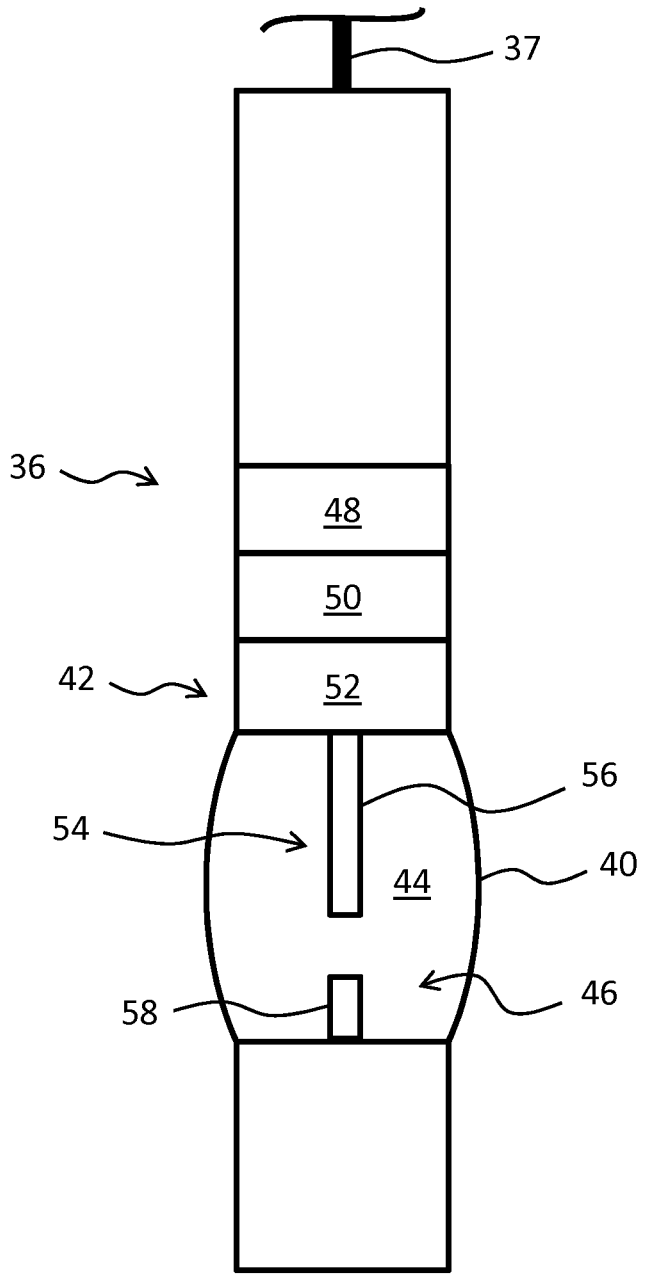
FIG. 4 schematically illustrates an embodiment of the shock wave generation device according to the invention.

As illustrated on FIG. 4, the shock wave generation device 36 is a source of electrohydraulic energy, which comprises a membrane 40 and an electrical discharge unit 42. The membrane 40 delimits a chamber 44 which is filled with a shock wave transmitting liquid 46. Such a membrane 40 isolates the liquid 46 in the chamber 44 from the production tubing string 22 while maintaining acoustic coupling with said production tubing string 22, improving the propagation of shockwaves while preventing external fluids from damaging the electrical discharge unit 42.

In a preferred embodiment, the membrane 40 is flexible in order to an efficient propagation of shock waves in many directions and prevent shock waves to bounce on it, allowing therefore an efficient conduction of the shock wave toward control particles 32, in particular toward areas of control particles 32 which are accessible with difficulty or inaccessible to mechanical means such as e.g. brushes or chemical means such as e.g. acid.

To this end, the membrane 40 may be made of fluorine rubber or fluoroelastomer with a relative elongation of at least 150%, preferably at least 200% and being operable between −35° C. and 250° C.

The electrical discharge unit 42 is configured for generating a series of electrical discharges that propagate a series of shock waves into the shock wave transmitting liquid 46 and through the membrane 40 toward the control particles 32 for removing blocking elements 35 from said control particles 32. The electrical discharge unit 42 may be configured to propagate shock waves radially or in a predetermined direction.

In this example, and as already describes in U.S. Pat. No. 4,345,650 issued to Wesley or U.S. Pat. No. 6,227,293 issued to Huffman, incorporated hereby by reference, the electrical discharge unit 42 comprises a power conversion unit 48, a power storage unit 50, a discharge control unit 52 and a discharge system 54. The discharge system 54 comprises a first electrode 56 and a second electrode 58 configured for triggering an electrical discharge.

The discharge system 54 comprises a plurality of capacitors (not represented) for storage of electrical energy configured for generating one or a plurality of electrical discharges into the shock wave transmitting liquid 46. The chamber 44 is delimited by the membrane 40 around the discharge system 54 which is filled with the shock wave transmitting liquid 46, allowing transmitting shock waves through the membrane 40 toward the control particles 32.

Electrical power is supplied by the low voltage source 38 at a steady and relatively low power from the surface 16 through the wireline 37 to the downhole shock wave generation device 36. The power conversion unit 48 comprises suitable circuitry for charging of the capacitors in the power storage unit 50. Timing of the discharge of the energy in the power from the power storage unit 50 through the discharge system 54 is accomplished using the discharge control unit 52.

In a preferred embodiment, the discharge control unit 52 is a switch, which discharges when the voltage reaches a predefined threshold. Upon discharge of the capacitors in the power storage section through the first electrodes 56 and the second electrode 58 of the discharge control unit 52, electrohydraulic shock waves 60 (in reference to FIG. 2) are transmitted to the control particles 32 for cleaning said control particle 32.

Other designs of discharge system 54 are disclosed in U.S. Pat. No. 6,227,293 issued to Huffman which is included hereby reference. According to the electrohydraulic effect, an electrical discharge is discharged in a very short time (few micro seconds) in the shock wave transmitting liquid 46.

Examples of Operation

The invention is describes in its application to removing deposits, in particular mineral deposits, and/or fines from control particles 32 and/or or redistributing deposits and/or fines located in between control particles 32, said control particles 32 being arranged in annulus 24 and perforations 20 for preventing the passage of sand formation when collecting formation fluids.

Figure 5:
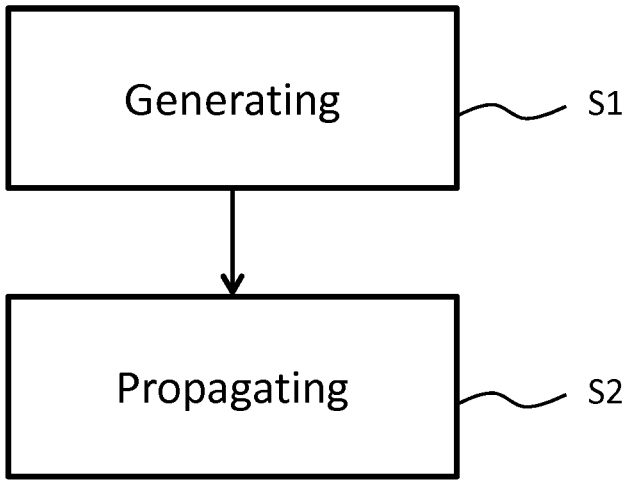
FIG. 5 illustrates an embodiment of the method according to the invention.

FIG. 5 illustrates an embodiment of the method for cleaning control particles 32 arranged in a borehole 10 of a subterranean formation 18 according to the invention. Prior to operate the method according to the invention, the sand control apparatus is at least partially blocked with blocking elements 35 (as described here above in reference to FIG. 3).

In a first step S1, a series of shock waves is generated into the control screen 30 nearby the control particles 32. In this example, the series of shock waves is generated into the shock wave transmitting liquid 46 of the shock wave generating device 36.

Then, in a second step S2, the series of shock waves propagates through the membrane 40 toward the control screen 30 and control particles 32 for removing blocking elements 35 located on or in between said control particles 32.

Preferably, the series of shock waves comprises at least ten shock waves, for example propagated at a periodic interval of time, e.g. every 5 to 20 seconds. A plurality of series may be advantageously repeated at different heights in the production tubing string 22 to remove blocking elements 35 in areas which would be inaccessible to mechanical or chemical means such as e.g. acid.

Figure 6:
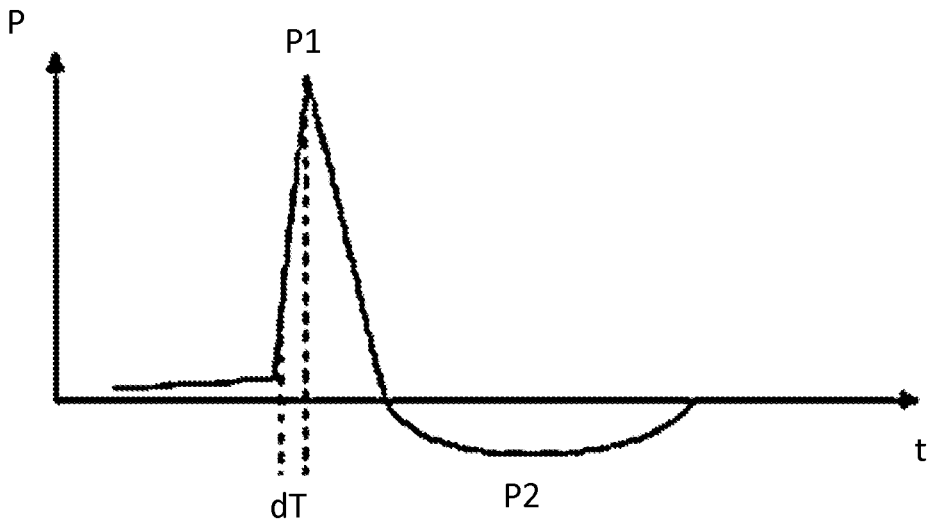
FIG. 6 shows the evolution of pressure with time of a shock wave generated by a shock wave generation device according to the invention.

FIG. 6 shows the variation of pressure with time nearby control particles 32. Firstly, the pressure generated by the shock wave increases in a very short time dT, e.g. a few microseconds, until a maximum P1. Such a peak phase characterizes a compression of blocking elements 35. Then, the pressure generated by the shock wave decreases to a negative value P2 for a significant amount of time, e.g. a few milliseconds.

This second phase characterizes a traction effort applied on blocking elements, which allows breaking said blocking elements 35, in particular in areas which are accessible with difficulty or inaccessible to mechanical or chemical means.

Such an traction effort is improved by the quality of propagation of the shock wave trough the shock wave transmitting liquid 46 and the membrane 40, allowing removing blocking elements 35 efficiently.

Supplemental Equipment

Embodiments include many additional standard components or equipment that enables and makes operable the described device, process, method and system.

Operation, control and performance of portions of or entire steps of a process or method can occur through human interaction, pre-programmed computer control and response systems, or combinations thereof.

Experiment

Examples of specific embodiments facilitate a better understanding of deposits removing method and device. In no way should the Examples limit or define the scope of the invention.

This method shows good results as at least 80% of blocking elements 35 are removed from or between control particles 32.

The invention is not limited to the described embodiment and can be applied to all type of formation fluids or gases transportation means.

The invention claimed is:

1. A shock wave generating device for cleaning control particles in a wellbore of a subterranean formation to improve the recovery of formation fluids and/or gases, said wellbore comprising a wall defining a borehole, at least one control equipment arranged into said borehole and a plurality of control particles arranged between said control equipment and said wall, said shock wave generating device comprising:

a chamber defined at least in part by a membrane, said chamber being partially filled with a shock wave transmitting liquid and which is adapted to be arranged into said borehole nearby said control equipment, said membrane is sized and shaped to isolate said shock wave transmitting liquid from external fluids during repeated use of the shock wave generating device; and an electrical discharge unit comprising a first electrode and a second electrode located in said chamber, said electrical discharge unit configured for generating at least one electrical discharge that propagates at least one shock wave into said shock wave transmitting liquid through said control equipment and said control particles for cleaning said control particles.

2. The shock wave generating device according to claim 1, wherein the electrical discharge unit is configured for generating at least one electrical discharge that propagates at least one shock wave into said shock wave transmitting liquid through said membrane nearby said control equipment for cleaning from control particles.

3. The shock wave generation device according to claim 1, wherein the membrane is deformable in order to efficiently conduct the shock wave towards the control particles.

4. The shock wave generation device according to claim 3, wherein the membrane is made of fluorinated rubber or other fluoroelastomer.

5. The shock wave generation device according to claim 1, wherein the electrical discharge unit comprises a power conversion unit, a power storage unit, a discharge control unit and a discharge system.

6. The shock wave generation device according to claim 5, wherein the first electrode and the second electrode are configured for generating a high voltage arc in the shock wave transmitting liquid.

7. The shock wave generation device according to claim 1, wherein the electrical discharge unit is configured for generating at least one electrical discharge that propagates at least one shock wave radially.

8. The shock wave generation device according to claim 1, wherein the electrical discharge unit is configured for generating at least one electrical discharge that propagates at least one shock wave in a predetermined direction.

9. A wellbore for recovering formation fluids or gases from a subterranean formation, said wellbore comprising a wall defining a borehole, at least one control equipment arranged into said borehole, a plurality of control particles arranged between said control equipment and said wall, and a shock wave generating device according to claim 1.

10. A system for cleaning control particles in a wellbore of a subterranean formation to improve the recovery of formation fluids and/or gases, said system comprising:

the wellbore comprising a wall defining a borehole, at least one control equipment arranged in said borehole and a plurality of control particles arranged between said control equipment and said wall;

a shock wave generation device comprising a chamber that is at least partially filled with a shock wave transmitting liquid and an electrical discharge unit for generating at least one electrical discharge that propagates at least one shock wave into said shock wave transmitting liquid through said at least one control equipment and said control particles for cleaning said control particles;

a wireline coupled to said shock wave generation device for inserting said shock wave generation device in the borehole nearby said at least one control equipment;

a voltage source located external of the borehole; and an electrical circuit within said wireline for connecting said voltage source to the shock wave generation device.

11. The system for cleaning control particles in a wellbore of a subterranean formation of claim 10, wherein the electrical discharge unit is configured for generating at least one electrical discharge that propagates at least one shock wave into said shock wave transmitting liquid through said membrane nearby said control equipment for cleaning from control particles.

12. The system for cleaning control particles in a wellbore of a subterranean formation of claim 10, wherein the control particles are at least one of sand, stone, ceramics, gravel, and sintered bauxite.

13. The system for cleaning control particles in a wellbore of a subterranean formation of claim 10, wherein the chamber is defined at least in part by a membrane that is sized and shaped to isolate said shock wave transmitting liquid from external fluids during repeated use of the shock wave generating device.

14. The system for cleaning control particles in a wellbore of a subterranean formation of claim 13, wherein the electrical discharge unit comprises a first electrode and a second electrode located in said chamber.

15. The system for cleaning control particles in a wellbore of a subterranean formation of claim 13, wherein the membrane is made of is made of fluorinated rubber or a fluoroelastomer-based material.

* * * * *